US005700964A

United States Patent [19]

Liu

[11] Patent Number: 5,700,964

[45] Date of Patent: Dec. 23, 1997

[54] DECORATIVE PLATE WITH DYNAMIC PHENOMENON

[76] Inventor: Jack Liu, No. 3, Alley 202, Kao-Fon Rd., Hsin-Chu City, Taiwan

[21] Appl. No.: 660,377

[22] Filed: Jun. 7, 1996

[51] Int. Cl.[6] ..... G10F 1/06

[52] U.S. Cl. ..... 84/95.2; 40/455; 446/298

[58] Field of Search ..... 84/94.1, 94.2, 84/95.1, 95.2; 40/455, 456; 446/298, 303

[56] References Cited

U.S. PATENT DOCUMENTS 5,584,742 12/1996 Chen .

*Primary Examiner*—Michael L. Gellner
*Assistant Examiner*—Shih-yung Hsieh
*Attorney, Agent, or Firm*—Beveridge, DeGrandi, Weilacher & Young, L.L.P.

[57] ABSTRACT

Accordingly, the object of the present invention is a decorative plate with dynamic phenomenon having a plate body and decorative card on the plate surface of the plate body, wherein a driven mechanism driven by a music box is provided by a plate body, and a vibrating rod and an auxiliary rod of the driven mechanism are installed on the external side of the plate surface, the ends of the vibrating rod and the auxiliary rod are pivotally connected with the positioning holes of the vibrating block; and the gap between the positioning holes is larger than that between the bases of the vibrating rod and the auxiliary rod; therefore, the decorative card on the plate surface is swung as a swing chair.

7 Claims, 6 Drawing Sheets

DECORATIVE PLATE WITH DYNAMIC PHENOMENON

BACKGROUND OF THE INVENTION

The present invention relates a decorative plate with dynamic phenomenon, especially, to a decorative plate in which the decorative card on the plate surface is swung as a swing chair.

DESCRIPTION OF THE PRIOR ART

In general, the conventional decorative plate, several patterns or photographs are adhered on the surface of the plate by printing or sticking, meanwhile, by the framework on the rear surface of the plate surface, the plate body is supported and is upright so that the object to display the patterns and photographs are achieves.

But in the prior art, the disadvantage of the plate surface is that the patterns and photographs on the plate surface are only statically presented and are unchangeable.

SUMMARY OF THE INVENTION

Accordingly, the object of the present invention is to present a decorative plate with dynamic phenomenon comprising a plate body and a decorative card on the plate surface of the plate body, wherein a driven mechanism driven by said music box is provided by plate body, and a vibrating rod and an auxiliary rod of the driven mechanism are installed on the external side of the plate surface, the ends of the vibrating rod and the auxiliary rod are privotly connected with the positioning holes of the vibrating block; and the gap therebetween is larger than that between the bases of the vibrating rod and the auxiliary rod; therefore, the decorative card on the plate surface is swung as a swing chair.

DESCRIPTION OF THE PREFERRED EMBODIMENT

Figure 1:
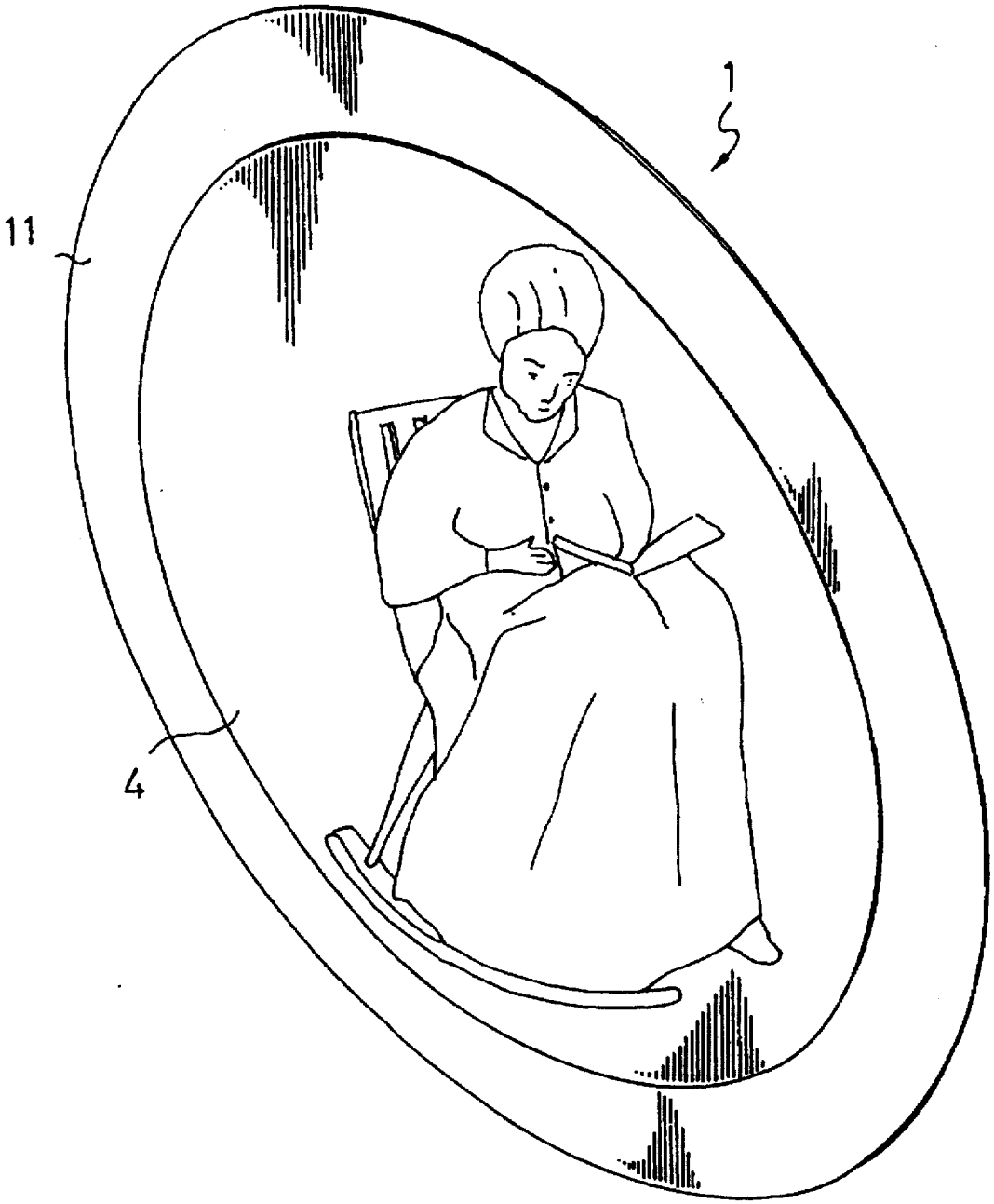
FIG. 1 is the cubic schematic view of the decorative plate of the present invention.

Referring to the FIG. 1, the decorative plate with dynamic phenomenon comprises a plate body (1) and a decorative card (4) on the plate surface (11) of the plate body.

Figure 2:
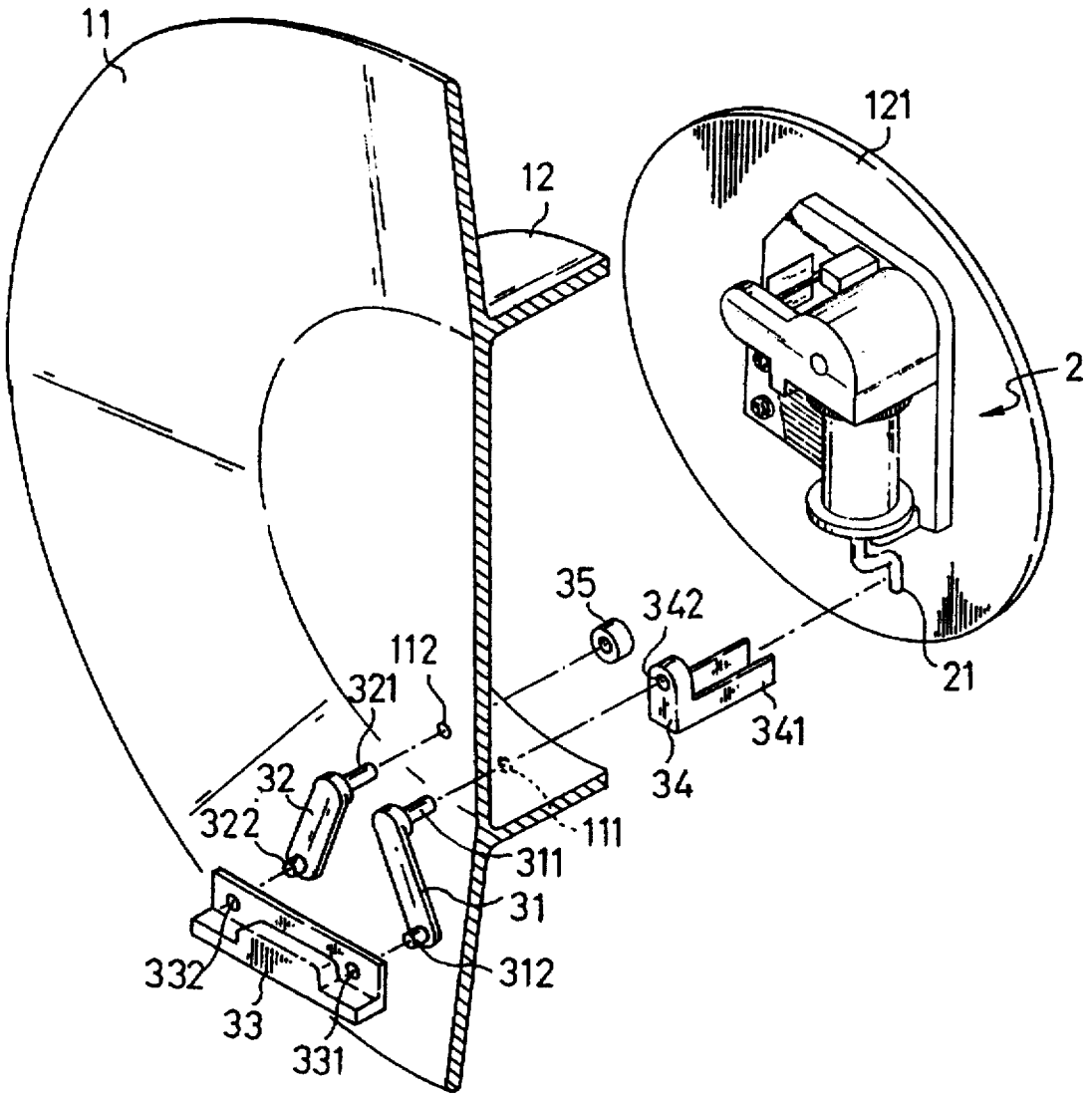
FIG. 2 is the cubic schematic view of assembly of the decorative plate in the FIG. 1.
Figure 3:
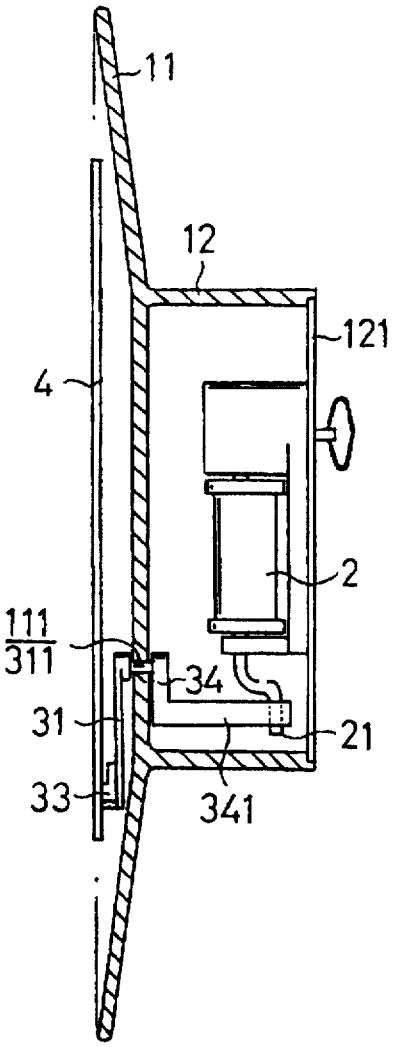
FIG. 3 is the cross section of the schematic view of assembly in the FIG. 1.

Said plate body (1) comprises a plate surface (11) and a base (12) on the rear side of the plate surface (11), and a music box is fixed on the rear plate (121) of the base (12), the power output side of the music box (2) is installed with an eccentric shaft (21), as shown in the FIGS. 2 and 3.

Moreover, a driven mechanism (3) driven by said music box is provided by the present invention, and a vibrating rod (31) and an auxiliary rod (32) of the driven mechanism (3) are installed on the external side of the plate surface (11). Transversal rotary axles (311, 321) directing to the direction of the plate surface (11) are installed on the bottom end of the vibrating rod (31) and the auxiliary rod (32), said rotary axles (311, 321) are extended below the center part of the plate surface (11) to engage with axle holes (111, 112). Besides, the ends of said vibrating rod (31) and the auxiliary rod (32) are provided with transversal positioning shafts (312, 322) opposite to the plate surface (11), the positioning shafts (312, 322) are privately connected with positioning holes (331, 332) of the vibrating block (33), respectively. A decorative card (4) is adhered to the outer surface of said vibrating block (33), which may be substituted by a cubic engraving article or object with a plate shape.

Figure 7:
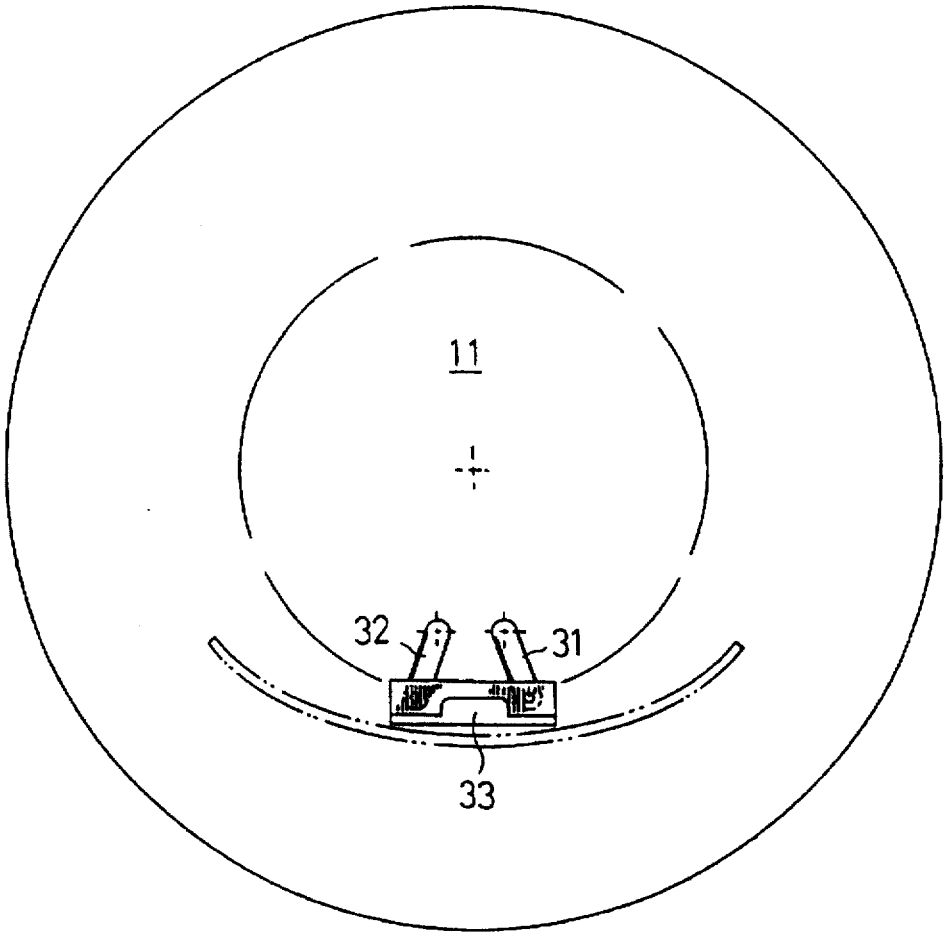
FIG. 7 shows the front view of a vibrating rod and a vibrating block, which shows the general condition wherein the vibrating block is in horizontal position.

The gap between the two axle holes (111, 112) is set to be smaller than the gap between the two positioning holes (331, 332) of the vibrating block (33), as shown in the FIG. 7.

Furthermore, a driven block (34) and a position ring (35) are installed inside base (12). Wherein the assembly hole (342) of driven block (34) is combined with the rotary axle (311) of the vibrating rod (31), and two extending arms (341) are extended transversely through the lower end of the vibrating block (34) so that the eccentric shaft (21) of the music box (2) is within the range of the two extending arms (341), and the positioning ring (35) is combined with rotary axle (321) of the auxiliary rod (32). The vibrating rod (31) and the auxiliary rod (32) are positioned on the axle direction of the plate surface.

By the structure of the driven mechanism (3), when power is released from the music box (2), the extending arm (341) of the driven block (34) is driven by the rotation of the eccentric shaft (21) so to rotate around the shaft center of the rotary shaft (311) according to the rotation angle thereof, i.e. said vibrating rod (31) is driven to from an radially vibrating, and the vibrating angle is dependent on the length from the assembly hole (342) of the driven block (34) to the extending arm (341). Because the positioning shaft (312) of the vibrating rod (31) and the positioning shaft (322) of the auxiliary rod (32) are pivotally connected with the positioning holes (331, 332) of the vibrating block (33), the auxiliary rod (32) is driven to vibrate synchronously.

Figure 8:
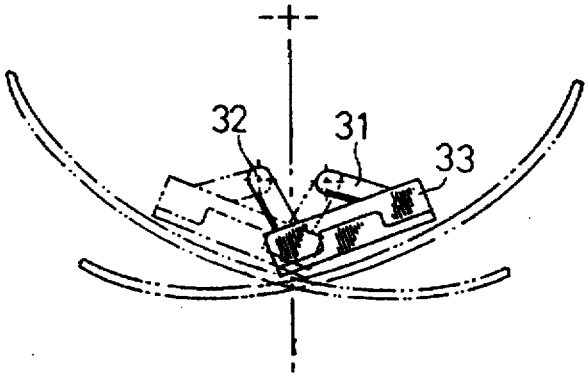
FIG. 8 shows the schematic view of a vibrating rod and a vibrating block in FIG. 7, which shows that the vibrating block is vibrated rightwards and leftwards.

FIG. 7 is a schematic view showing the vibrating block in a horizontal state. The gap between the two axle holes (111, 112) is set to be smaller than the gap between the two positioning holes (331, 332) of the vibrating block (33), so the vibrating block (33) and the auxiliary rod (32) are slanted to the outward direction, then when the vibrating rod is driven to the right to vibrate, as shown in FIG. 8. The horizontal elevation of the lower portion of the vibrating rod (33) is raised continuously, however, initially, the horizontal elevation of the lower portion of the auxiliary rod (32) is descended, and is slightly risen at the end of the vibration. Conversely, when the vibrating rod (31) is driven to the left to vibrate, the horizontal height of the lower end of the vibrating rod (31) is opposite to that of the auxiliary rod (32). According to the vibrating conditions of the vibrating rod (31) and the auxiliary rod (32), the vibrating block (33) and decorative card (4) present a swinging action as a swing chair.

Figure 4:
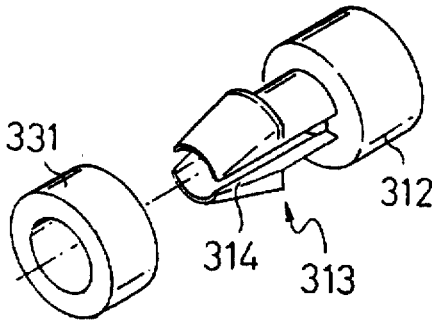
FIG. 4 shows the cubic schematic view of the combination relation between the round elastic buckle and positioning hole.
Figure 5:
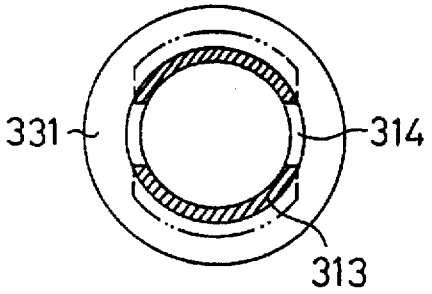
FIG. 5 shows the cross section schematic view of the combination relation between the round elastic buckle and positioning hole of the FIG. 4.
Figure 6:
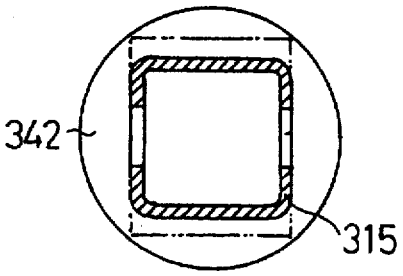
FIG. 6 shows the cross section schematic view of the rectangular elastic buckle of a vibrating rod and a driving block.

The positioning shaft (312) of the vibrating rod (31) is privotly engaged with the positioning hole (311) of the vibrating block (33) so that the vibrating rod (33) is adhesively connected with the positioning shaft (312) and the engaging condition is maintained. The assembly method shown in the FIG. 4 and 5 is a preferred selection. An end of a notched round elastic buckle (314) is formed on the end portion of the positioning shaft (312), the front end of the buckle (312), is formed as a sloping cone, thereby, when the buckle is inserted toward the positioning hole (331), the buckle (313) is compressed for extending through the positioning hole (331), and after passing through the positioning hole (331), by the elastic force of the buckle (313) itself, the buckle is resilient to combined with the positioning hole (331), and to retain the engagement between the positioning shaft (312) and the positioning hole (331).

The combination manner between the positioning shaft (322) of auxiliary rod (32) and the positioning hole (332) of vibrating block is similar as described hereinbefore.

The conveniential combination aforementioned may be changed to use in the engagement of the rotary shaft (311) of vibrating rod and the, assembly hole (342) of the driven block (111), wherein a rectangular elastic buckle (315) is formed on the end portion of the rotary shaft (311), said assembly hole is respectively formed as a rectangular hole, therefore, after the buckle has been combined in the assembly hole (342), the buckle (315) and the assembly hole (342) are fixedly engaged.

Figure 9:
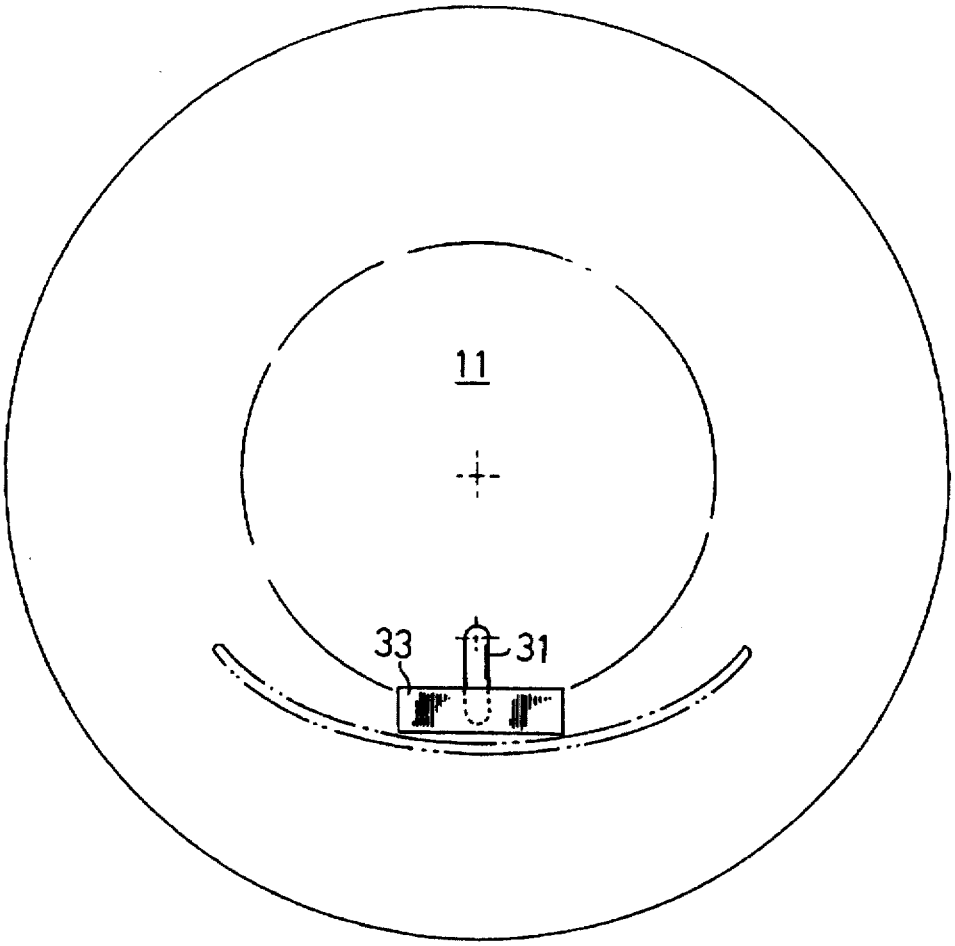
FIG. 9 shows a modified embodiment of a driving mechanism of a decorative plate.
Figure 10:
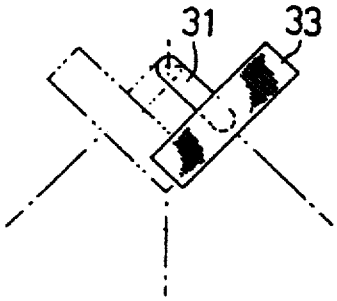
FIG. 10 shows the schematic view of a vibrating rod and a vibrating block in FIG. 9, which shows that the vibrating block is vibrated rightwards and leftwards.

In the aforementioned embodiment, the swing in the right and left direction is controlled by the vibrating rod (31) and auxiliary rod (32). In order to simplify the structure of the driven mechanism (3), a modified embodiment is shown in the FIG. 9, the single end of the vibrating rod (31) is connected with the center of the vibrating block (33), then when the driven block (34) is vibrated toward right and left direction, said vibrating block (33) and vibrating rod (31) is swung synchronously, as shown in FIG. 10.

Figure 11:
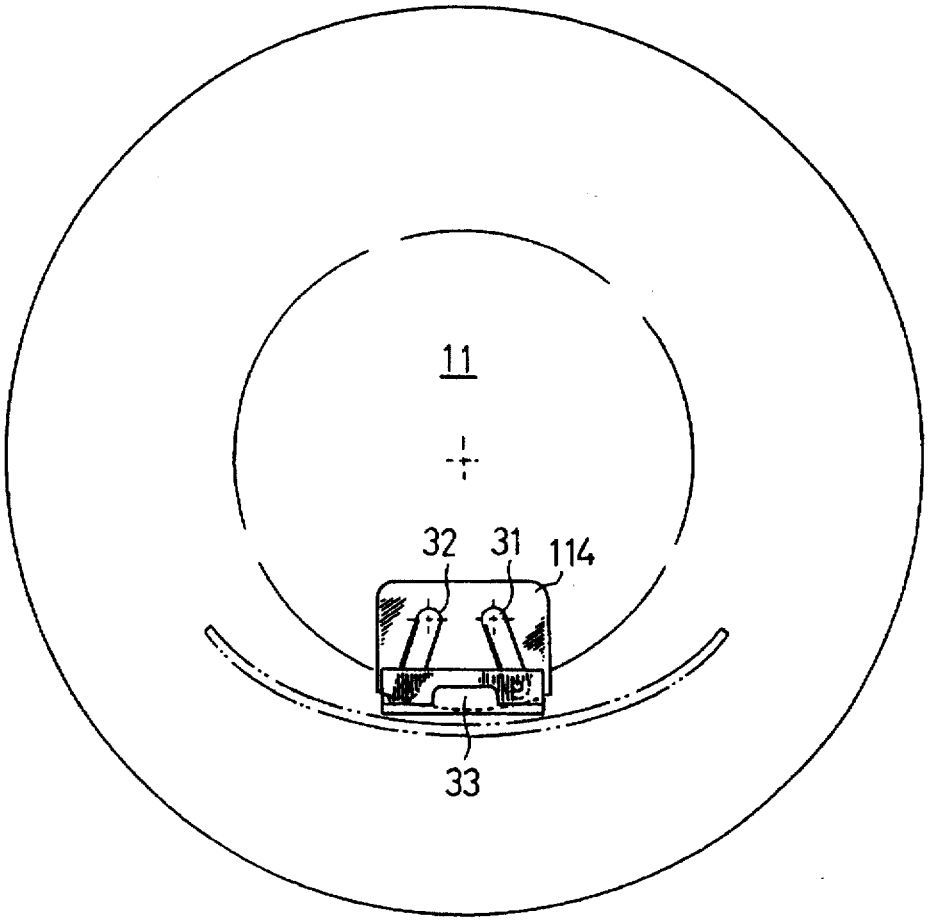
FIG. 11 shows a modified embodiment of an assembled component combined by the vibrating block and vibrating rod.
Figure 12:
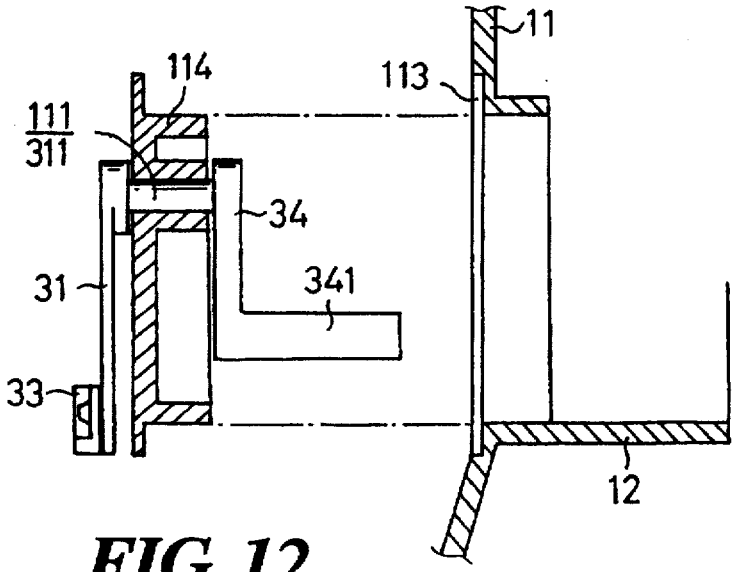
FIG. 12 is the cross section view of the assembled component of FIG. 11, which shows the assembled relation between the vibrating block, the driving block and the plate surface.

In the embodiment described hereinbefore, the rotary shafts (311, 321) of the vibrating rod (31) and/or the auxiliary rod (32) are engaged in the axle holes (111, 112) of the plate surface (11) so that in the assembly of the components, the worker must hold the plate surface (11) by hand, therefore, if the plate surface is much larger, assembly is difficult to perform. Accordingly, another structure is shown in the FIGS. 11 and 12, wherein, a rectangular opening (113) is installed within the range of the plate surface axle hole (111, 112), and an assembling component (114) which is retained in the plate surface (11), is opposite to the rectangular opening (113), and is installed to tightly engage the rectangular opening (113). The wall surface of the assembling component (114) is formed with an axle hole (111, 112) for engaging said rotary axle (311, 321). By this structure, the vibrating rod (31) and/or auxiliary rod (32), rotary axle (311, 321), driven block (34) and/or positioning ring (35) are assembled previously into the predetermined position of the assembling component (114). After assembly is completed, the assembling component (114) is assembled in the opening (113) of the plate surface (11), which is positioned to tightly engage with the opening (113).

What is claimed is:

1. A decorative plate with dynamic phenomenon comprising:

a plate having a front surface, a back surface, and an opening therethrough, a base attached to said back surface, a rear plate attached to said base, a music box mounted on said rear plate, a rotatable eccentric shaft extending from said music box, a driven block having a pair of spaced extending arms in engagement with said eccentric shaft, said driven block defining an assembly hole therethrough, an assembly component mounted within said opening, said assembly component having a pair of axle holes, a decorative card, a vibrating block attached to said decorative card, said vibrating block having a pair of positioning holes, a pair of positioning shafts each in pivotal communication with one of said pair of positioning holes, a vibrating rod connected to one of said pair of positioning shafts, said vibrating rod having a rotary axle passing through one of said axle holes to said assembly hole, an auxiliary rod connected to the other of said pair of positioning shafts, said auxiliary rod having a rotary axle at an end opposite said positioning shaft and passing through said other axle hole, and a position ring secured to said rotary axle of said auxiliary rod; and wherein the gap between said pair of axle holes is smaller than the distance between said positioning holes.

2. The decorative plate with dynamic phenomenon as recited in claim 1, wherein each said positioning shaft has an end portion formed as a notched round elastic buckle, and a front end of the buckle is formed as a sloping cone.

3. The decorative plate with dynamic phenomenon as recited in claim 1, wherein a notched rectangular elastic buckle is formed by an end portion of the rotary axle in communication with an end of the vibrating rod.

4. The decorative plate with dynamic phenomenon as recited in claim 3, wherein said assembly hole is rectangular.

5. The decorative plate with dynamic phenomenon as recited in claim 1, wherein a horizontal elevation of said assembly component is the same level as that of said plate surface.

6. A decorative plate with dynamic phenomenon comprising:

a plate having a front surface, a back surface, and an opening therethrough, a base attached to said back surface, a rear plate attached to said base, a music box mounted on said rear plate, a rotatable eccentric shaft extending from said music box, a driven block having a pair of spaced extending arms in engagement with said eccentric shaft and said driven block defining an assembly hole therethrough, an assembly component engaging said opening, said assembly component having an axle hole, a decorative card, a vibrating block attached to said decorative card, said vibrating block having a positioning hole, a positioning shaft in pivotal communication with said positioning hole, and a vibrating rod connected to said positioning shaft, said vibrating rod having a rotary axle connected to an end opposite said positioning shaft passing through said axle hole to said assembly hole.

7. A decorative plate with dynamic phenomenon comprising:

a plate having a front surface, a back surface, and an axle hole therethrough, a base attached to said back surface, a rear plate attached to said base, a music box mounted on said rear plate, a rotatable eccentric shaft extending from said music box, a driven block having a pair of spaced extending arms in engagement with said eccentric shaft and said driven block defining an assembly hole therethrough, a decorative card, a vibrating block attached to said decorative card, said vibrating block having a positioning hole, a positioning shaft in pivotal communication with said positioning hole, and a vibrating rod connected to said positioning shaft, said vibrating rod having a rotary axle connected to an end opposite said positioning shaft passing through said axle hole to said assembly hole.

* * * * *